US008985025B1

(12) United States Patent
Manz et al.

(10) Patent No.: US 8,985,025 B1
(45) Date of Patent: Mar. 24, 2015

(54) SUBMUNITION AND CLUSTER MUNITION CONTAINING SUBMUNITIONS

(75) Inventors: Paul C. Manz, Andover, NJ (US); Philip J. Magnotti, Westfield, NJ (US); Ryan Gorman, Mountain Lakes, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 290 days.

(21) Appl. No.: 13/608,461

(22) Filed: Sep. 10, 2012

Related U.S. Application Data

(60) Provisional application No. 61/567,238, filed on Dec. 6, 2011.

(51) Int. Cl.
*F42B 12/58* (2006.01)
*F42B 12/20* (2006.01)
*F42B 12/24* (2006.01)

(52) U.S. Cl.
CPC ..... *F42B 12/58* (2013.01); *F42B 12/208* (2013.01); *F42B 12/24* (2013.01)
USPC ..... 102/489

(58) Field of Classification Search
USPC ..... 102/489, 384, 393, 382
See application file for complete search history.

(56) References Cited

U.S. PATENT DOCUMENTS 4,157,068 A * 6/1979 Rognmo ..... 102/489
6,481,666 B2 * 11/2002 Frucht ..... 244/3.15
8,119,957 B2 * 2/2012 Wich ..... 244/3.19

* cited by examiner

*Primary Examiner* — Reginald Tillman, Jr.
(74) *Attorney, Agent, or Firm* — Michael C. Sachs

(57) ABSTRACT

A cluster munition may include a plurality of submunitions that are ejected from a delivery vehicle. Each submunition is single target discriminating and includes electronic self-destruct and self-deactivate capability. Each submunition includes a microprocessor and a wireless communication device connected to the microprocessor. Each submunition includes a deployable antenna/stabilizer that functions as an antenna for the wireless communication device and as a stabilizer to stabilize the descent of the submunition. Optionally, the deployable antenna/stabilizer may also facilitate ejection of the submunition from the delivery vehicle. The submunitions may wirelessly communicate with each other and with other entities.

18 Claims, 9 Drawing Sheets

SUBMUNITION AND CLUSTER MUNITION CONTAINING SUBMUNITIONS

CROSS-REFERENCE TO RELATED APPLICATIONS

The present application claims the benefit of priority of U.S. provisional patent application Ser. No. 61/567,238 filed on Dec. 6, 2011, which is incorporated by reference herein.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to submunitions and cluster munitions.

Cluster bombs may be dispensed from dispensers and dropped in a pattern to blanket a target area. This method may be used to increase the probability that an individual submunition will encounter, engage, and destroy targets within the target area. Submunitions may be ejected in a dispersion pattern that may depend on the nature of the ejection mechanism used in the submunition carrier. Submunitions may be armed as they are dispensed from the cluster bomb or other carrier. If the submunitions do not encounter and engage a target, they may remain unexploded, armed, and lethal when they impact the ground and after impact with the ground.

This overall approach to engaging one or more targets with many individual munitions or dispensed submunitions is often referred to as an "area attack" and is a statistical methodology for defeating targets. Area attack may be contrasted with "precision attack," which typically uses one precision-guided munition to engage each target individually. Assuming an accurate target location, precision attack may yield a higher percentage of kills per munition, but at a substantially higher cost due to the use of precision guidance and control on each munition.

Submunitions of various kinds may be ejected or dispersed from a carrier, such as a missile, mortar, rocket or cannon projectile. Generally, the carrier brings the submunitions to a location close to the target, and the submunitions are then ejected or dispersed near the target. The submunitions may free fall from the ejection location and rely on statistical distribution to hit the target, or the submunitions may include a guidance system to move them closer to the target. A number of methods are known for guiding the submunitions to the final target.

One method employs terminal guidance systems, such as infrared seekers and other IR detection and guidance systems, as shown, for example, in U.S. Pat. No. 4,492,166. Another method provides mechanical control systems, such as aerofoils or special wings with a target detector, such as those shown in U.S. Pat. No. 5,155,294 and U.S. Pat. No. 4,635,553. In U.S. Pat. No. 4,554,871, assigned to Allied Corporation, there is disclosed a missile that carries at least two asymmetric submunitions. The guidance system on each submunition causes the submunition to precess about its center axis, thereby creating an appropriate search pattern or controlling the flight path of the submunition after a suitable target has been acquired by the submunition's guidance system.

Satellite aided global location systems, such as the Global Positioning System (GPS), are also well known in the art.

These systems utilize several satellites to permit a body on the earth to calculate, such as by triangulation, its precise location on the globe. Global location systems today are used in guidance systems for a wide variety of objects. These include munitions, such as bombs and missiles. There is shown, for instance, in U.S. Pat. No. 5,943,009, assigned to Northrop Grumman Corporation, a munition with a tail fin assembly, at least one flight control surface having an actuator, and a guidance system having a GPS receiver for effecting control of the actuator to facilitate guiding of the munition.

U.S. Pat. No. 5,260,709 discloses a system and method that uses differential computation of position relative to a GPS coordinate system and the computation of an optimum weapon flight path to guide a weapon to a non-moving fixed or re-locatable target. The system comprises an airborne platform with a navigation subsystem that utilizes the GPS satellite system to provide the coordinate system, and a synthetic array radar (SAR) to locate desirable targets. Targeting is done prior to weapon launch; therefore, the weapon requires only a navigation subsystem that also utilizes the GPS satellite system to provide the same coordinate system that the platform uses.

There is shown in U.S. Pat. No. 5,507,452 a precision guided system suitable for use in conventional aircraft-launched bombs. The system includes a kit mounted upon the nose of the conventional bomb which replaces the conventional fuse disposed in a fuse well. The kit includes guidance electronics that control a self-contained jet reaction device and GPS P-code receiver electronics. The bombs are readied for discharge by signals broadcast from the aircraft into the bomb bay. Readying the bombs includes transferring initial GPS data and commencing operation of a gas generator which powers the jet reaction device.

There is shown in U.S. Pat. No. 6,481,666 a method and system for guiding submunitions in which a satellite-aided global location system is utilized to control a parachute disposed on each submunition. In particular, the orientation of the parachute is adjusted by a servo, which in turn is controlled by the guidance system, thus allowing alteration in direction of downward travel of the submunition. U.S. Pat. Appl. Publication No. 2007/0266884 discloses a dispenser system for controllably deploying components, such as unmanned ground sensors, into a desired pattern and orientation. The dispenser system utilizes a GPS-based guidance system to control the deployment of the main canister, rather than the submunitions.

All of the above-mentioned systems include the use of satellite-aided global location systems to guide a munition over a relatively long distance and/or control a relatively complex guidance system (to control, for example, the orientation of fins, parachutes, etc.). Thus, the electronics and control system required to guide the munitions are complex and expensive to manufacture and maintain. Further, the submunitions themselves are incapable of communicating with one another so as provide selective targeting. Moreover, deployment of conventional cluster munitions results in relatively high incidences of unexploded ordinance.

The Oslo Treaty dated May 30, 2008 requires that all cluster munitions weighing less than 20 kg contain less than 10 submunitions. Each submunition must be single target discriminating, must weigh more than 4 kg, and must have an electronic self-destruct and self-deactivate capability. The conventional cluster munitions described above do not meet the Oslo Treaty requirements. A need exists for a cluster munition and submunitions that meet the Oslo Treaty requirements, while also providing effective targeting and enemy elimination characteristics.

SUMMARY OF THE INVENTION

It is an object of the invention to provide a cluster munition and submunitions that meet the Oslo Treaty requirements, while also providing effective targeting and enemy elimination characteristics.

One aspect of the invention is a submunition. The submunition may include a submunition body with explosive material therein. A deployable antenna/stabilizer is attached to the submunition body. A wireless communication device is disposed on the submunition and is electrically connected to the deployable antenna/stabilizer. A microprocessor is disposed on the submunition and is electrically connected to the wireless communication device. A means for determining a relative location of the submunition is electrically connected to the microprocessor. A multi-mode fuze is electrically connected to the microprocessor. The multi-mode fuze includes at least two of: (a) a proximity fuze for detonating the submunition in a selected proximity of the submunition to a target; (b) a point detonating fuze for detonating the submunition when contacting a target; and (c) a timer-based fuze for detonating the submunition after a selected time has elapsed.

The deployable antenna/stabilizer may be, for example, at least one of a coil, a foldable flat spring and a drogue chute.

The submunition may include one or more sensors selected from the group consisting of, for example, IR sensor, microwave sensor, laser sensor, UV sensor, barometer, and altimeter. The sensors are electrically connected to the microprocessor.

Another aspect of the invention is a cluster munition. The cluster munition includes a submunition delivery vehicle having a main body portion. A plurality of the inventive submunitions are disposed in the main body portion. The delivery vehicle may include a wireless communication device and a microprocessor electrically connected to the wireless communication device.

Another aspect of the invention is a method that includes launching the cluster munition and ejecting the plurality of inventive submunitions from the delivery vehicle. The method includes creating a wireless communication network between the wireless communication devices of the plurality of submunitions. Creating the network may include creating a wireless communication network between the wireless communication devices of the plurality of submunitions and the wireless communication device of the delivery vehicle.

The method may include determining relative locations of the plurality of submunitions using each submunition's means for determining relative location. Target location information may be sent from the microprocessor of the delivery vehicle to respective microprocessors of each of the plurality of submunitions.

The target location information may include a single desired target location for each submunition, a listing of all possible target locations, and a friendly/hostile identifier for each of the all possible target locations.

The method may include using each submunition's respective microprocessor and means for determining relative location to estimate the submunition's end location; then, comparing the submunition's estimated end location to its single desired target location; and then, executing a safe action if the estimated end location is not the single desired target location or if the desired target location has a friendly identifier. The safe action may include one of deactivating the submunition and detonating the submunition.

The method may include, for each submunition that reaches ground, wirelessly transmitting from the submunition information regarding location of the submunition and status of the submunition. The status information may include one of a pre-deactivation state and a pre-self-destruct state.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
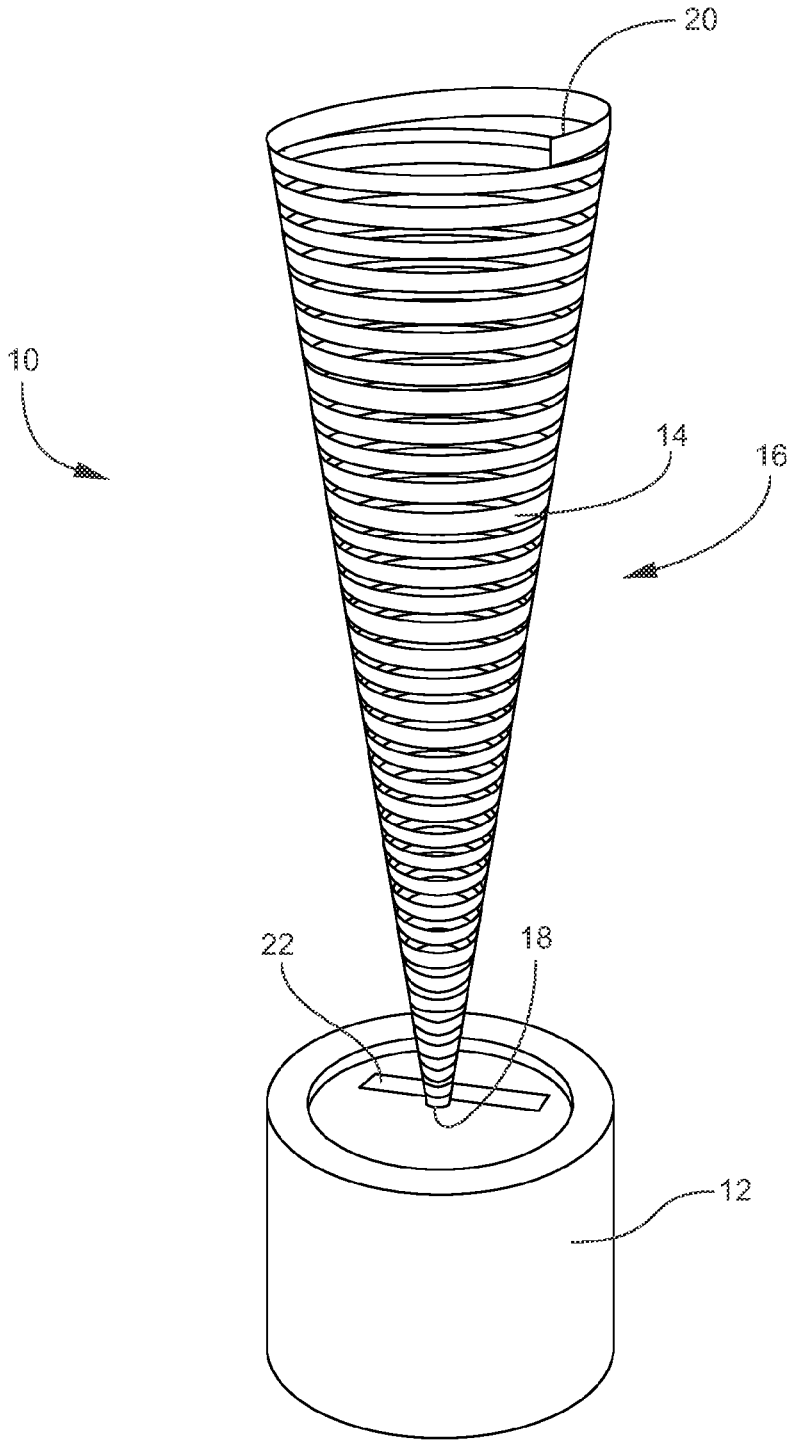
FIG. 1 is a perspective view of one embodiment of a submunition.

FIG. 1 shows an embodiment of a submunition 10 having a submunition body 12 and a deployable antenna/stabilizer 16 attached to submunition body 12. Deployable antenna/stabilizer 16 performs at least two functions. A first function is to act as a wireless communications antenna. A second function is to aerodynamically stabilize, orient, or decelerate submunition 10 during its descent. A third, optional function is to facilitate ejection of submunition 10 from a delivery vehicle 30 (FIG. 4) using spring force. Deployable antenna/stabilizer 16 may be embodied in several forms.

Figure 2:
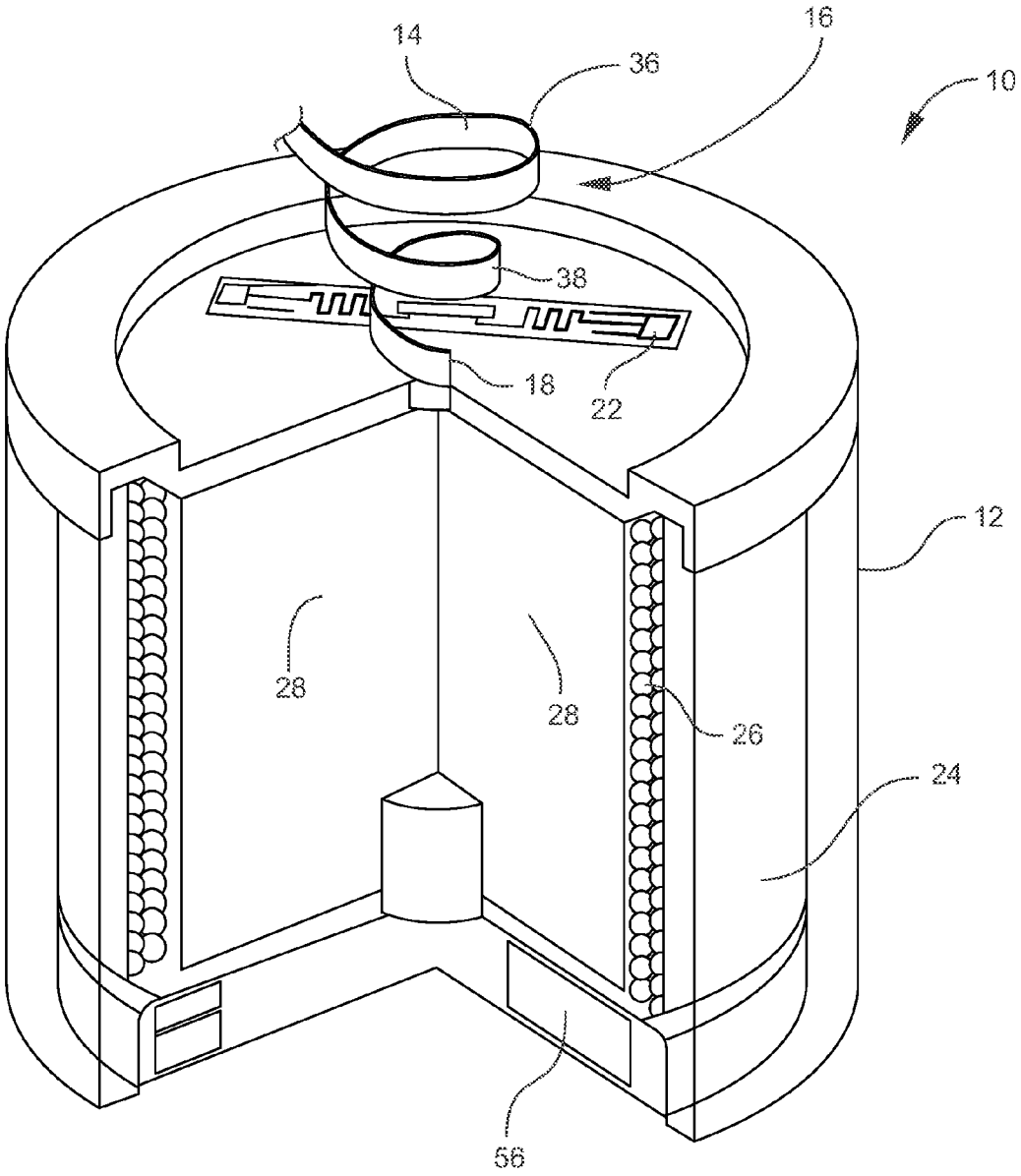
FIG. 2 is a partially transparent, cut away perspective view of the submunition body of FIG. 1.

In FIG. 1, deployable antenna/stabilizer 16 is in the form of a coil 14 having a first end 18 attached to submunition body 12 and a second end 20 opposite first end 18. In the deployed or uncompressed state of FIG. 1, second end 20 is distal submunition body 12 and coil 14 has a diameter that increases from first end 18 to second end 20. Coil 14 may stabilize the orientation of submunition 10 as it descends in the air. Coil 14 may be made of, for example, a metallic or semi-metallic material Coil 14 may be coiled on its edge 36 (FIG. 2) or may be coiled about its face 38 (FIG. 2). Coiling about face 38 will present a larger surface area in the direction of descent of submunition 10 and increase the drag. Coil 14 may include a plurality of curved and/or straight portions.

One or more wireless communication devices 22 (FIG. 1) may be disposed on submunition 10. Wireless communication device 22 may be electrically connected to coil 14. Coil 14 may function as an antenna for wireless communication device 22. Wireless communication device 22 may communicate with communication devices exterior to submunition 10 for purposes such as, for example, receiving programming data, transmitting sensor data, etc. Wireless communication device 22 may be, for example, an active and/or passive RFID chip, a laser, or a microwave or millimeter wave communication device.

Figure 1A:
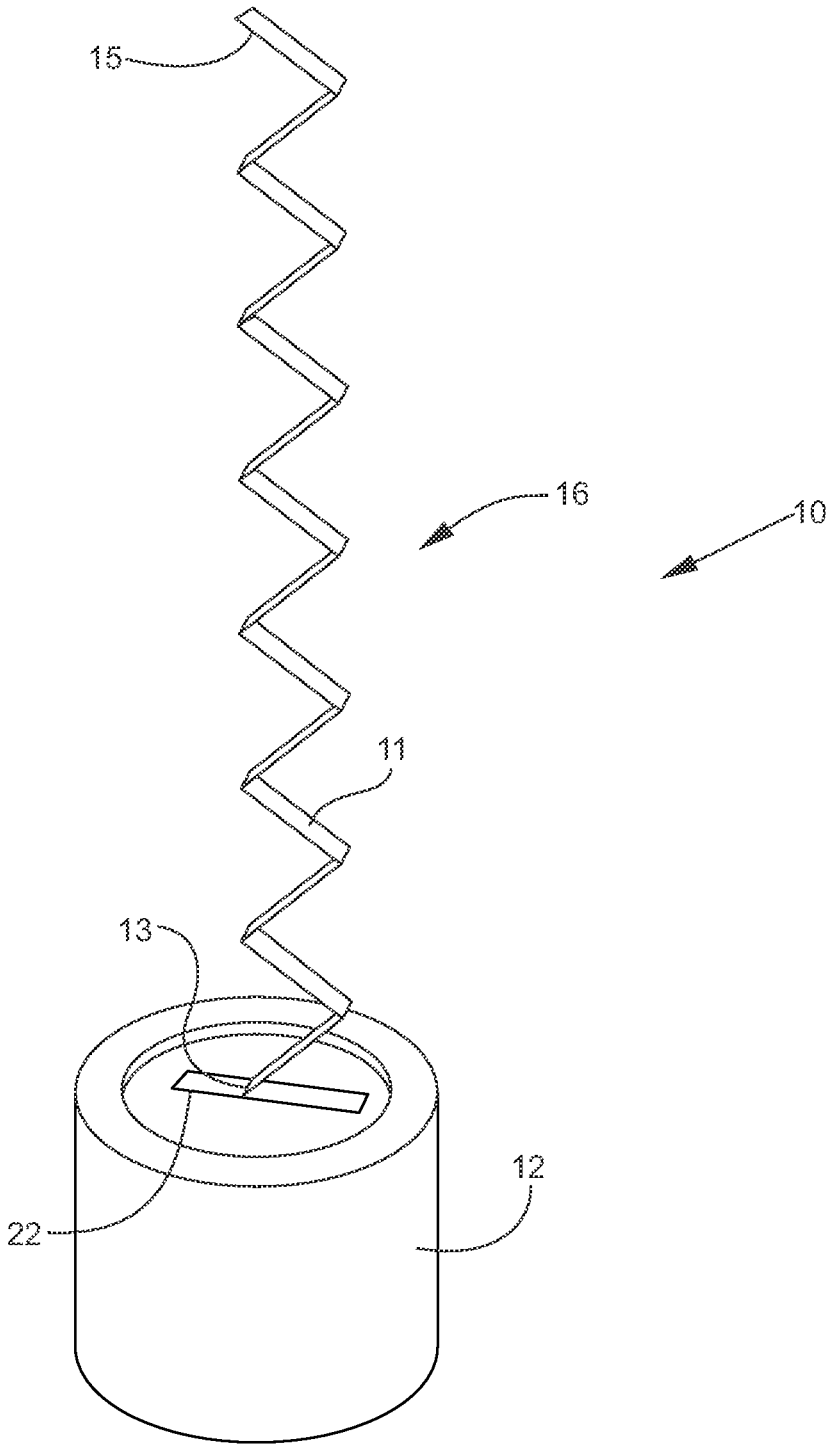
FIG. 1A is a perspective view of another embodiment of a submunition.

In FIG. 1A, deployable antenna/stabilizer 16 is in the form of a foldable flat spring 11 having a first end 13 attached to submunition body 12 and a second end 15 opposite first end 13. FIG. 1A shows foldable flat spring 11 in a deployed state. Foldable flat spring 11 may be made of, for example, a metallic or semi-metallic material. Foldable flat spring 11 may be electrically connected to and act as an antenna for wireless communication device 22. Foldable flat spring 11 may also aerodynamically stabilize, orient, or decelerate submunition 10 during its descent. One or more foldable flat springs 11 may be used with a single submunition body 12.

FIG. 2 is a partially transparent, cut away perspective view of submunition body 12 of FIG. 1. Only the lower portion of coil 14 is shown in FIG. 2. Submunition body 12 may be made of any conventional material, for example, a metallic material that is prone to high fragmentation when submunition 10 is detonated. Body 12 may include a metal case 24 that may be scored to increase fragmentation. Ball bearings 26 may be disposed in metal case 24 to increase lethality, if desired. Explosive material 28 may be disposed in body 12.

Figure 3:
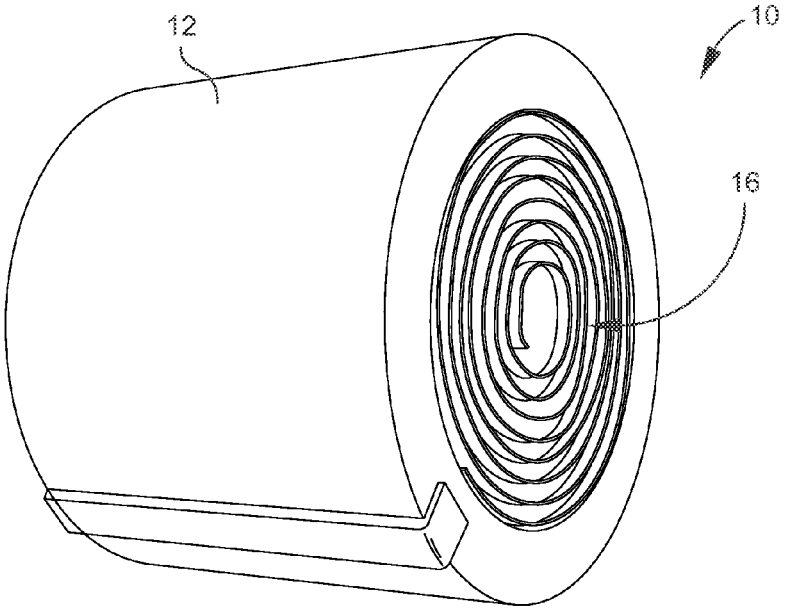
FIG. 3 is a perspective view of the submunition of FIG. 1 with the compressible stabilizer in a compressed state.
Figure 4:
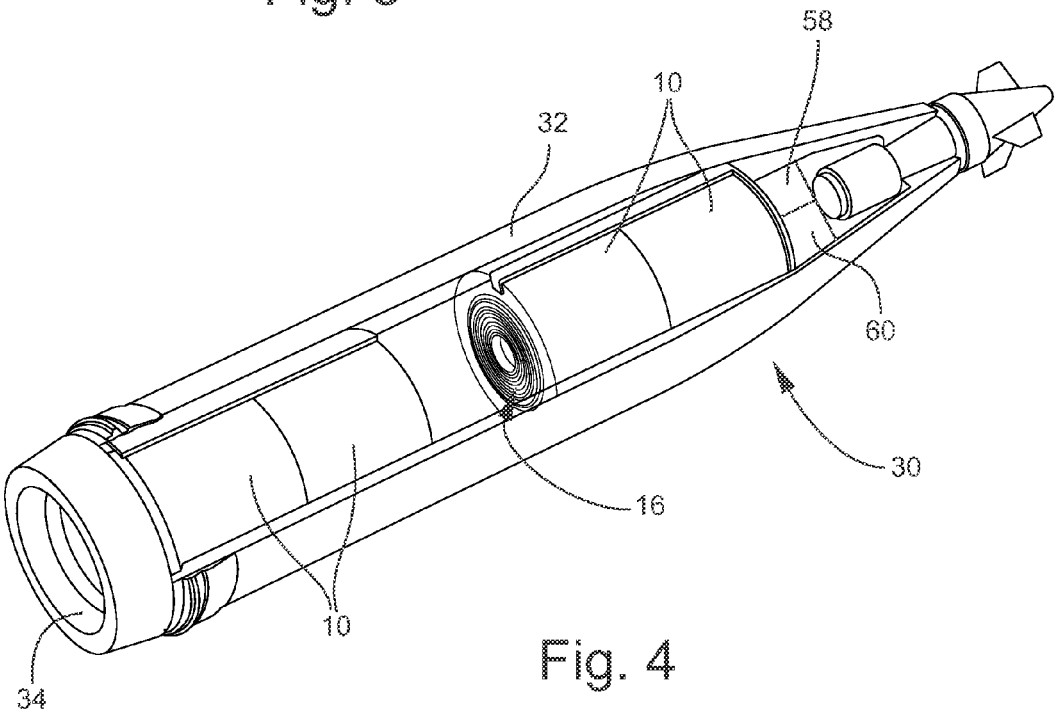
FIG. 4 is a partially cut away perspective view of one embodiment of a cluster munition.
Figure 5:
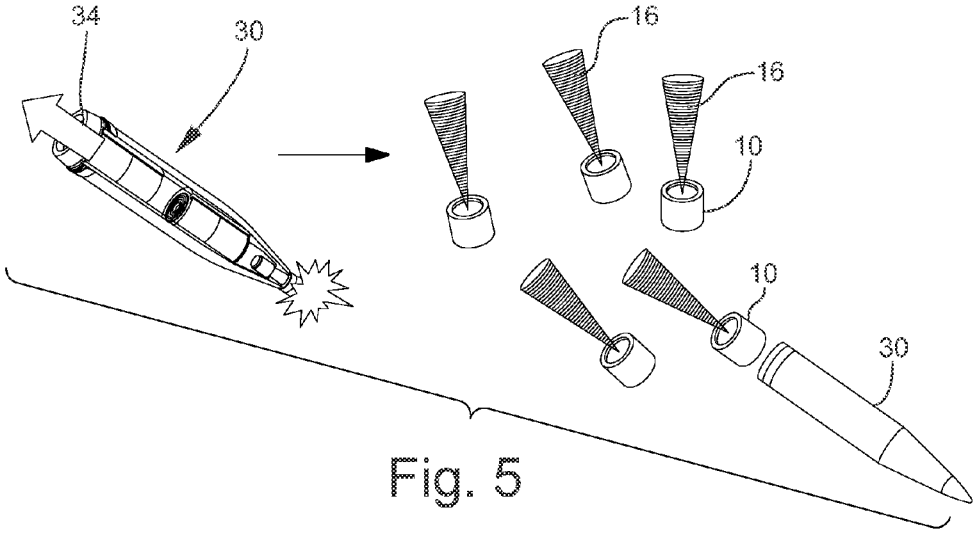
FIG. 5 is a temporal sequence showing ejection of submunitions from a delivery vehicle.

FIG. 3 shows deployable antenna/stabilizer 16 in the form of coil 14 in a compressed state, prior to deployment of submunition 10. When used as deployable antenna/stabilizer 16, foldable flat spring 11 may be similarly compressed prior to deployment of submunition 10. FIG. 4 shows a plurality of submunitions 10 disposed in a delivery vehicle 30. Submunitions 10 may be stacked in a main body portion 32 of delivery vehicle 30. Deliver vehicle 30 may be, for example, an artillery shell or cartridge. When compressed as shown in FIGS. 3 and 4, deployable antenna/stabilizer 16 may exert a spring force and function as an ejection means to facilitate ejection of submunition 10 from a rear 34 of delivery vehicle 30. FIG. 5 illustrates submunitions 10 being ejected from rear 34 of delivery vehicle 30.

Figure 6:
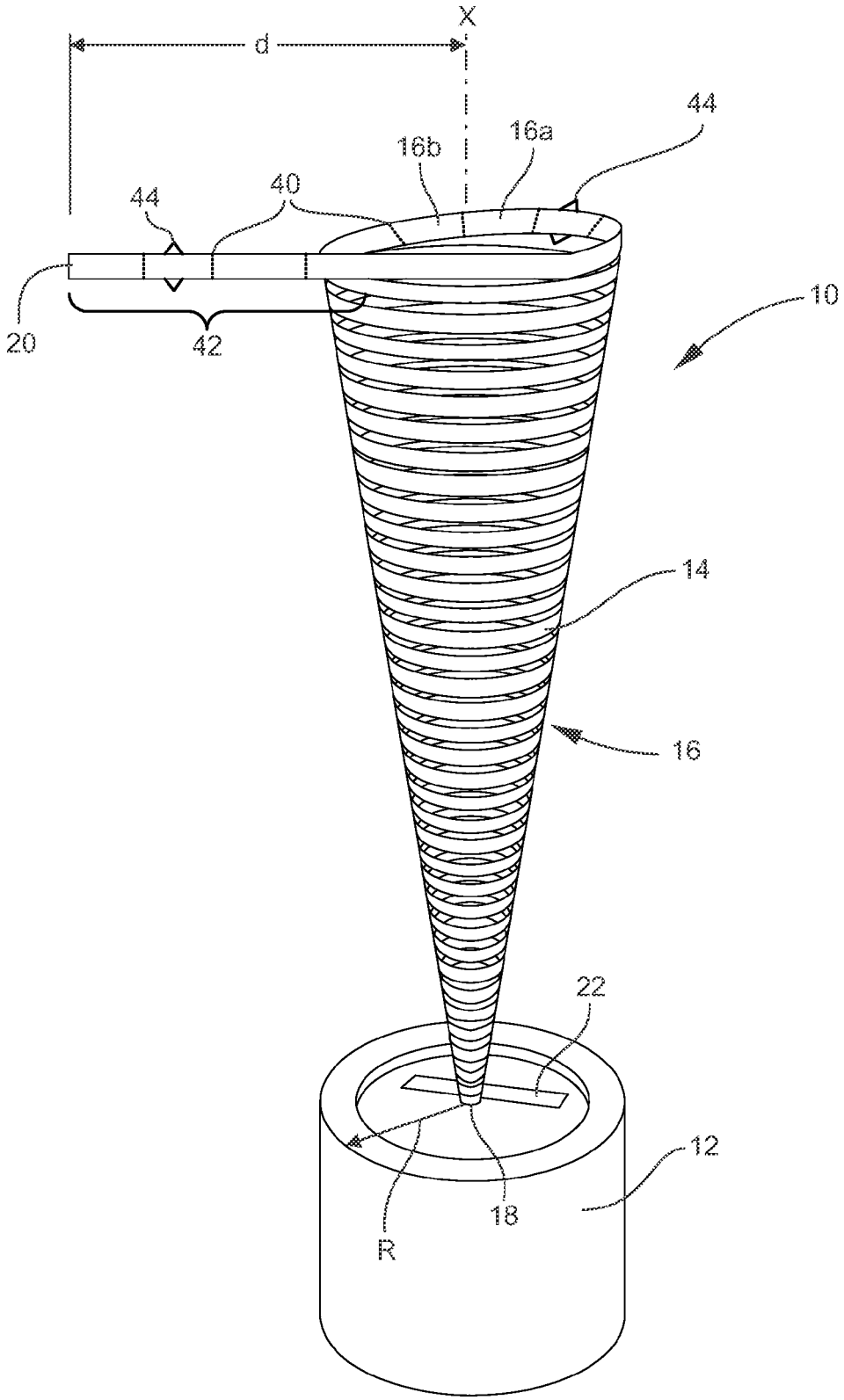
FIG. 6 is a perspective view of the submunition of FIG. 1 showing additional features of one embodiment of a deployable antenna/stabilizer.

As seen in FIG. 6, coil 14 may be scored in certain locations to define discrete sections, such as sections 16*a* and 16*b*, between scoring lines 40. Scoring lines 40 enable sections of coil 14 to be easily and cleanly broken off to tailor the overall length of coil 14 to fit in various delivery vehicles. Such tailoring is especially useful when retrofitting existing cluster munition delivery vehicles with embodiments of submunitions 10.

In the embodiment of FIG. 6, coil 14 includes a straight portion 42 at second end 20. After submunition 10 is ejected from delivery vehicle 30, coil 14 springs into the uncompressed state shown in FIG. 6 and straight portion 42 may extend radially beyond the external radius or the circumference of submunition body 12. That is, distance d in FIG. 6 is greater than the length of external radius R of body 12 so that straight portion 42, acting as an antenna for wireless communication device 22, may transmit and receive RF signals to objects below (at lower elevations than) submunition 10. Such objects may include other submunitions 10 ejected from delivery vehicle 30 or from another delivery vehicle.

One or more projections 44 may be attached to or formed integral with coil 14. Projections 44 may increase the effective RF transmission and reception range of coil 14, acting as antenna for wireless communication device 22. Projections 44 may take any desired shape and size, as long as they do not hinder the compressibility of coil 14.

Figure 7:
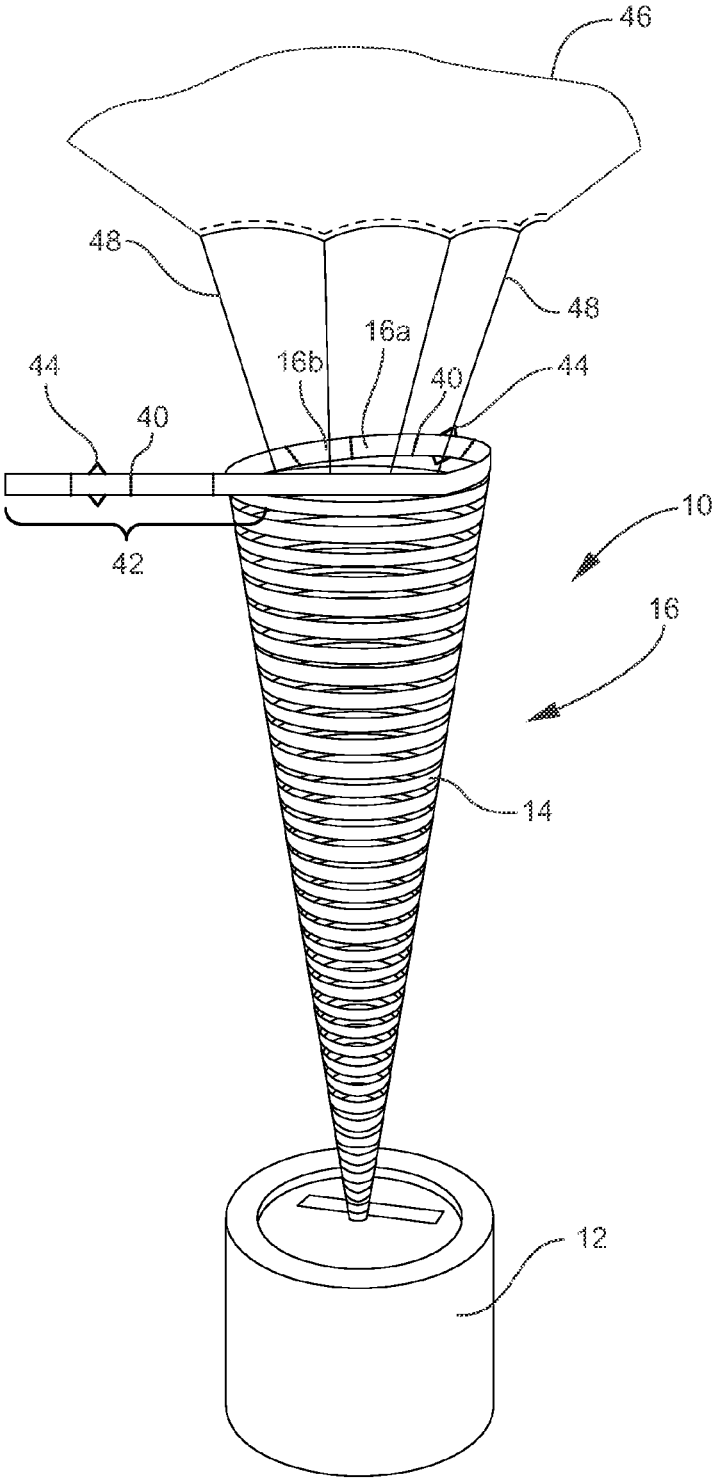
FIG. 7 is a perspective view of the submunition of FIG. 6 including another embodiment of a deployable antenna/stabilizer.

In addition to coil 14 and flat foldable spring 11, another form of deployable antenna/stabilizer 16 is a drogue chute 46 (FIG. 7). Drogue chute 46 may be desirable for more massive submunitions 10. Drogue chute 46 may be used with or without one of coil 14 and flat foldable spring 11. Drogue chute 46 may be attached to submunition body 12 with rigging lines 48. Drogue chute 46 can provide additional drag, thereby slowing descent of submunition 10. Drogue chute 46 may also help provide proper orientation of submunition 10 relative to the ground. Parachutes, X-drags, or other means of increasing drag may also be used.

Figure 7A:
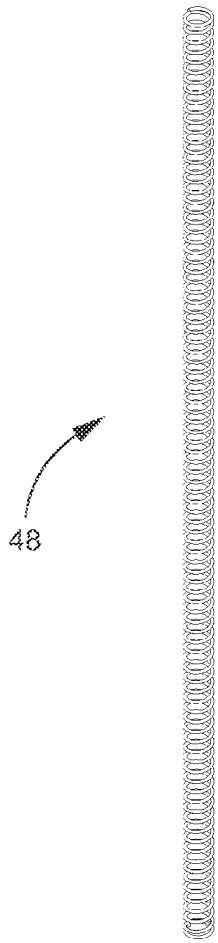
FIG. 7A is a perspective view of a coil spring rigging line.

Rigging lines 48 attach drogue chute 46 to submunition body 12. Rigging lines 48 may be partially or wholly made of metallic and/or semimetallic material. Rigging lines 48 may be electrically connected to wireless communication device 22 and may function as an antenna for wireless communication device 22. If it is desired that drogue chute 46 also facilitate ejection of submunition 10 from delivery vehicle 30, then each rigging line 48 may be in the form of a small, tightly wound coil spring (FIG. 7A). When used with coil 14, rigging lines 48 of drogue chute 46 may be looped through coil 14 to thereby create an omnidirectional loop antenna. The length of rigging lines 48 may be adjusted to vary the drag on submunition 10, to tailor rigging lines 48 to a desired radio frequency, or to conform to the size of coil. To increase drag, the diameter of drogue chute 46 may be greater than the diameter of the submunition body 12.

Figure 8:
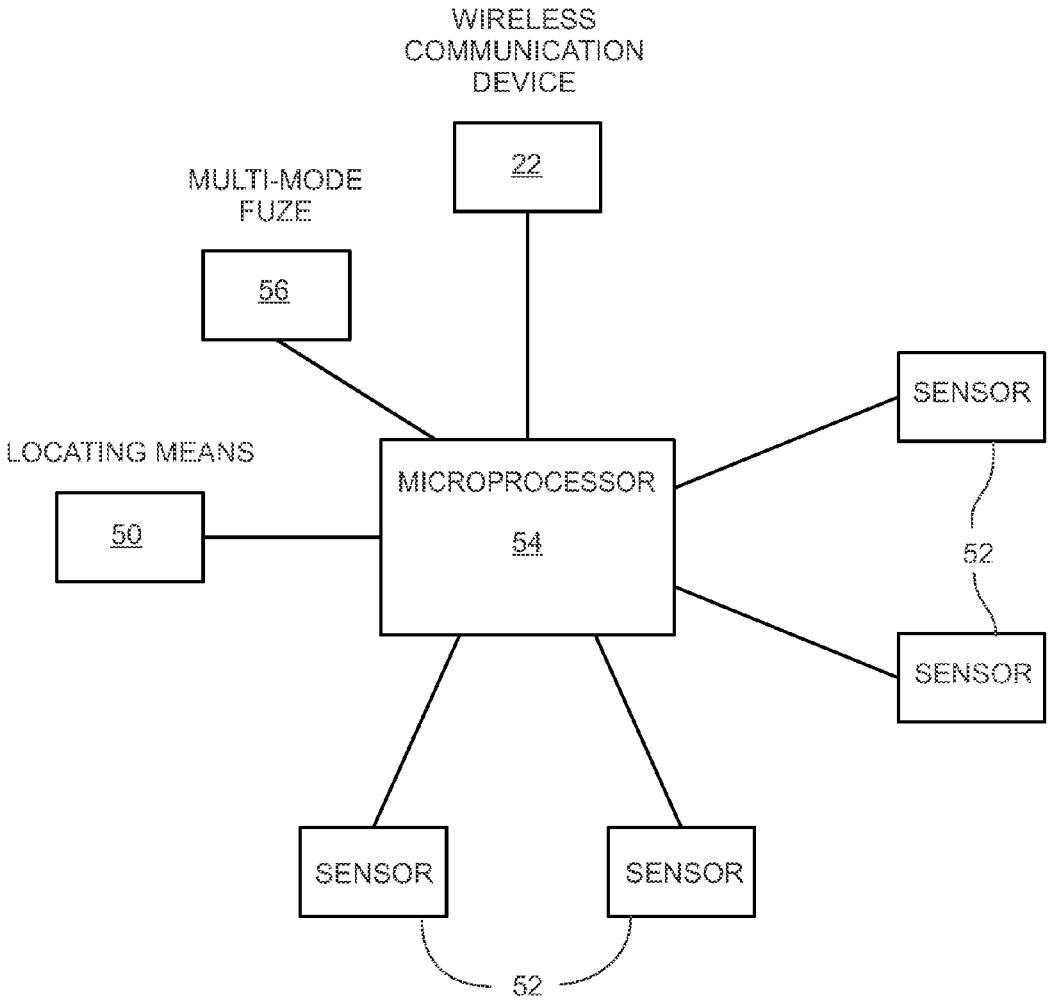
FIG. 8 is a block diagram of electrically connected components of a submunition.

As shown in FIG. 8, submunition 10 may include a programmable microprocessor 54 electrically connected to various devices, for example, wireless communication device 22, sensors 52, a multi-mode fuze 56 (FIG. 2), and position locating means 50. Position locating means 50 may determine at least the relative spatial location of submunition 10 and, in some embodiments, the absolute location of submunition 10. Position locating means 50 may be, for example, a polarized RF relative positioning system. RF relative positioning systems are disclosed in, for example, U.S. Pat. No. 7,193,556 issued on Mar. 20, 2007; U.S. Pat. No. 7,298,255 issued on Nov. 20, 2007; and U.S. Pat. No. 7,425,918 issued on Sep. 16, 2008, which are all expressly incorporated by reference herein. Position locating means 50 may include an altimeter. Another type of locating means 50 is a GPS (global positioning system). The GPS may provide absolute location of submunition 10. In the claims, the "means for determining a relative location of the submunition" corresponds to locating means 50.

A variety of sensors 52 may be connected to microprocessor 54 to transmit and receive data. Sensors 52 may be disposed in any appropriate location within or on submunition 10. Examples of sensors 52 are IR sensors, microwave sensors, laser sensors, UV detectors, temperature sensors, altimeters, barometers, timers, etc. Sensors 52 such as IR sensors, microwave sensors, and laser sensors may be used to measure proximity of submunition 10 to a target or location and/or provide data utilized to single target discriminate. Single target discrimination helps to avoid collateral damage. Environmental sensors, such as an altimeter, etc., may also assist in single target discrimination. In addition, environmental sensors may indicate that submunition 10 should be deactivated, for example, when submunition 10 has not exploded for a predetermined period of time after deployment.

Figure 9:
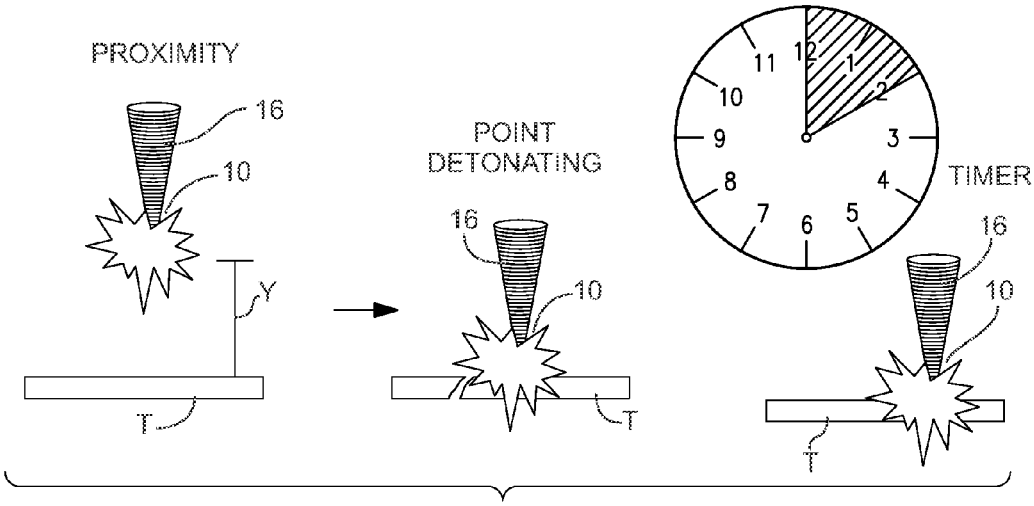
FIG. 9 is a temporal sequence showing detonation modes of a multi-mode fuze for a submunition.

Multi-mode fuze 56 may include at least two of: (a) a proximity fuze for detonating submunition 10 in a selected proximity of the submunition 10 to a target; (b) a point detonating fuze for detonating submunition 10 when contacting a target; and (c) a timer-based fuze for detonating submunition 10 after a selected time has elapsed. Preferably, multi-mode fuze 56 includes all three types of the afore-mentioned fuzes. As shown in FIG. 9, the proximity fuze may detonate submunition 10 when it is in a proximity distance Y of a target T. If the proximity fuze fails, the point detonating (impact) fuze may initiate detonation upon impact of submunition 10 with target T. If the point detonating fuze also fails, a timer-based fuze initiates detonation within a preset time period after firing. Multiple layers of redundancy are provided by multi-mode fuze 56, which greatly diminishes the possibility of unexploded ordnance being left in the field.

In one embodiment, a cluster munition or delivery vehicle 30 (FIG. 4) includes a programmable microprocessor 58 and a wireless communication device 60 electrically connected to microprocessor 58. Prior to or after launching delivery vehicle 30, target information may be loaded onto microprocessor 58 of delivery vehicle 30 and/or onto microprocessors 54 of submunitions 10 contained in delivery vehicle 30.

Figure 10:
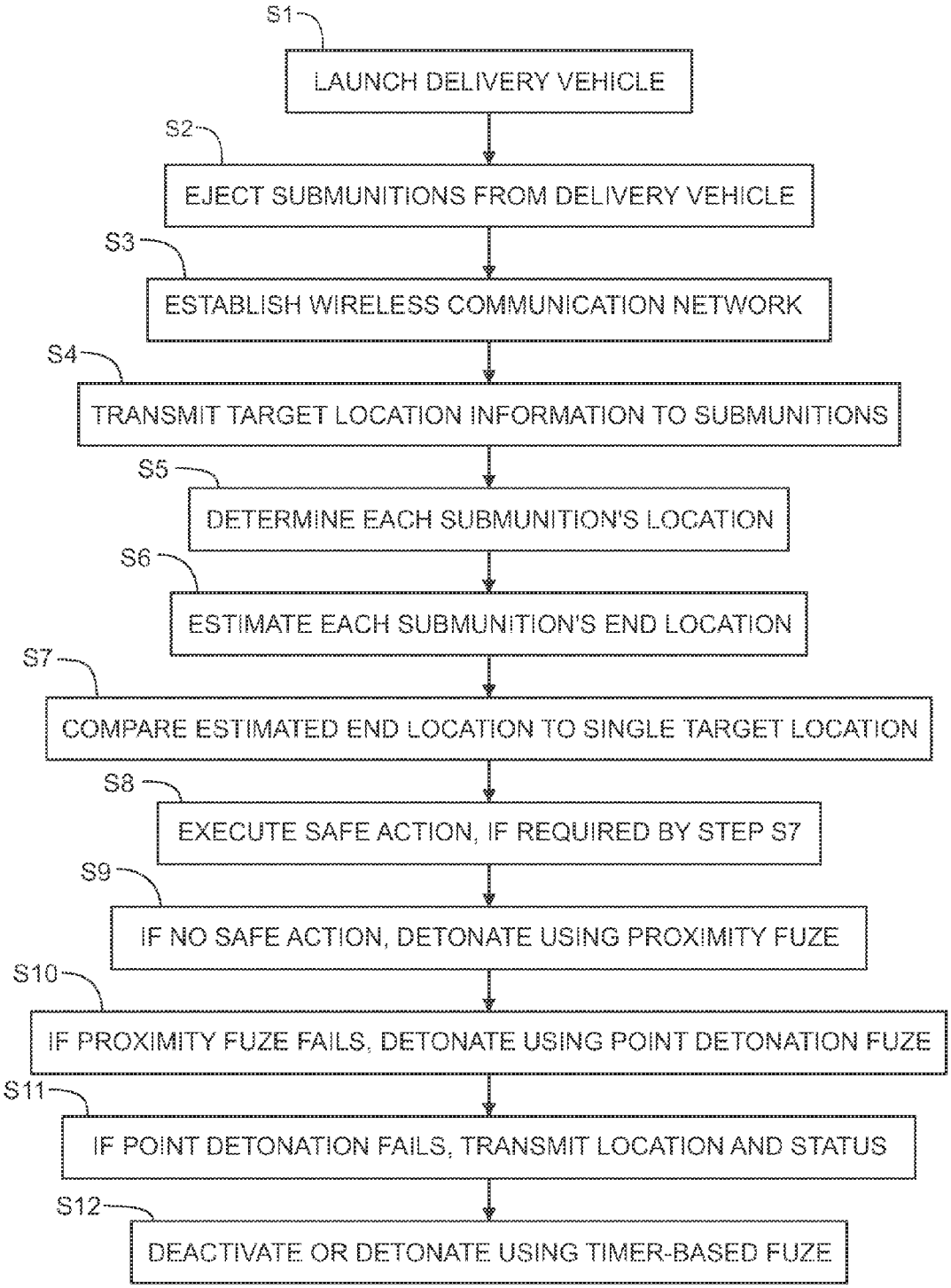
FIG. 10 shows one embodiment of a method of deploying a cluster munition with submunitions.

FIG. 10 illustrates one embodiment of a method of deploying a cluster munition or delivery vehicle 30 containing submunitions 10. In step S1, delivery vehicle 30 is launched from, for example, a gun tube. In step S2, at a selected point in the flight of delivery vehicle 30, submunitions 10 are ejected from delivery vehicle 30. In step S3, wireless communication devices 22, 58 of the submunitions 10 and vehicle 30 form a wireless communication network. In addition, other submunitions 10, delivery vehicles 30, and nearby entities (such as a drone or manned aircraft) may be part of the wireless communication network.

Before launch or at any point in the process, in step S4, wireless communication device 60 of delivery vehicle 30 or another wireless communication device (for example, a wireless device on a drone or manned aircraft) may send target location information to each submunition 10. The target location information may include a single desired target location $X_N$ for each submunition 1 through N (Table 1), a listing of all possible target locations (Table 2), and a friendly/hostile identifier for each of the all possible target locations (Table 2). One way to specify locations is by specifying latitude, longitude, and elevation.

TABLE 1

| SINGLE DESIRED TARGET LOCATION | |
|---|---|
| Submunition Number | Target Location Number |
| 1 | $X_1$ |
| 2 | $X_2$ |
| 3 | $X_3$ |
| N | $X_N$ |

TABLE 2

| Target Location Number | Target Location | Identifier |
|---|---|---|
| $X_1$ | Lat., Long. Elev. | Hostile |
| $X_2$ | Lat., Long. Elev. | Hostile |
| $X_3$ | Lat., Long. Elev. | Friendly |
| $X_N$ | Lat., Long. Elev. | Hostile |

In step S5, position locating means 50 of each submunition 10 may determine each submunition's absolute or relative position. The position information may be wirelessly communicated to other submunitions 10 and delivery vehicles 30. In step S6, each submunition's respective microprocessor 54 and locating means 50 may be used to estimate that submunition's end location. In step S7, microprocessor 54 may then compare the submunition's estimated end location with its single desired target location. In step S8, microprocessor 54 may then execute a "safe action" if the estimated end location is not the single desired target location or if the desired target location has a friendly identifier. The "safe action" may include one of deactivating submunition 10 and detonating submunition 10.

If no safe action was executed in step S8, and submunition 10 is in proximity to its single desired target, then, in step S9, proximity fuze in multi-mode fuze 56 will detonate submunition 10. If the proximity fuze fails and submunition 10 impacts its single desired target, then, in step S10, the point-detonating fuze of multi-mode fuze 56 will detonate submunition 10. If submunition 10 reaches the ground without detonating, then, in step S11, submunition 10 may wirelessly transmit its location information and its status information to, for example, one or more delivery vehicles 30 or another wireless communication device that is in range of submunition 10, such as a communication device in a drone or manned aircraft. The status information may include whether submunition 10 is preparing to deactivate or whether submunition 10 is preparing to self-destruct. The location information and status information of submunition 10 after it reaches the ground is an important tool in eliminating the problem of unexploded ordnance. In step S12, submunition 10 will deactivate (for example, if submunition 10 is in a friendly location) or detonate (for example, if submunition 10 is in a hostile location).

While the invention has been described with reference to certain preferred embodiments, numerous changes, alterations and modifications to the described embodiments are possible without departing from the spirit and scope of the invention as defined in the appended claims, and equivalents thereof. For example, deployable antenna/stabilizer 16 may be embodied in forms other than coil 14, foldable flat spring 11, or drogue chute 46.

What is claimed is:

1. A submunition comprising:

a submunition body including explosive material therein;

a deployable antenna/stabilizer attached to the submunition body, the deployable antenna/stabilizer having a first end attached to the submunition body and a second end opposite the first end wherein, in a deployed state, the second end is distal the submunition body;

a wireless communication device disposed on the submunition, the wireless communication device being electrically connected to the deployable antenna/stabilizer;

a microprocessor disposed on the submunition, the microprocessor being electrically connected to the wireless communication device;

means for determining a relative location of the submunition, the means for determining the relative location being electrically connected to the microprocessor; and a multi-mode fuze disposed on the submunition, the multi-mode fuze being electrically connected to the microprocessor, the multi-mode fuze including at least two of: (a) a proximity fuze for detonating the submunition in a selected proximity of the submunition to a target; (b) a point detonating fuze for detonating the submunition when contacting a target; and (c) a timer-based fuze for detonating the submunition after a selected time has elapsed, wherein the deployable antenna/stabilizer comprises at least one of a coil, a foldable flat spring and a drogue chute.

2. The submunition of claim 1, wherein the deployable antenna/stabilizer comprises one of the coil and the foldable flat spring, and further comprises the drogue chute wherein the drogue chute is attached to the submunition body with rigging lines.

3. The submunition of claim 2, wherein the wireless communication device is electrically connected to the rigging lines of the drogue chute.

4. A submunition comprising:

a submunition body including explosive material therein;

a deployable antenna/stabilizer attached to the submunition body, the deployable antenna/stabilizer having a first end attached to the submunition body and a second end opposite the first end wherein, in a deployed state, the second end is distal the submunition body;

a wireless communication device disposed on the submunition, the wireless communication device being electrically connected to the deployable antenna/stabilizer;

a microprocessor disposed on the submunition, the microprocessor being electrically connected to the wireless communication device;

means for determining a relative location of the submunition, the means for determining the relative location being electrically connected to the microprocessor; and a multi-mode fuze disposed on the submunition, the multi-mode fuze being electrically connected to the microprocessor, the multi-mode fuze including at least two of: (a) a proximity fuze for detonating the submunition in a selected proximity of the submunition to a target; (b) a point detonating fuze for detonating the submunition when contacting a target; and (c) a timer-based fuze for detonating the submunition after a selected time has elapsed, wherein the deployable antenna/stabilizer comprises at least one of a coil, a foldable flat spring and a drogue chute, and, wherein the deployable antenna/stabilizer comprises the coil and the coil includes scoring in predetermined locations to define discrete sections thereof.

5. The submunition of claim 4, wherein the coil includes one or more projections extending therefrom to thereby increase an effective wireless transmission and reception range of the coil.

6. The submunition of claim 4, wherein the discrete sections include at least one curved section.

7. The submunition of claim 4, wherein the discrete sections include at least one straight section.

8. The submunition of claim 7, wherein the at least one straight section is disposed at the second end of the coil and extends radially beyond an external radius of the submunition body to thereby enable radio frequency communication with objects located below the submunition body.

9. A cluster munition comprising a submunition delivery vehicle having a main body portion with a plurality of the submunitions of claim 8 disposed in said main body portion, and wherein the delivery vehicle includes a wireless communication device and a microprocessor electrically connected to the wireless communication device.

10. A method, comprising:

launching the cluster munition of claim 9; and ejecting the plurality of submunitions from the delivery vehicle, and further comprising creating a wireless communication network between the wireless communication devices of the plurality of submunitions.

11. The method of claim 10, wherein creating the network includes creating a wireless communication network between the wireless communication devices of the plurality of submunitions and the wireless communication device of the delivery vehicle.

12. The method of claim 11, further comprising determining relative locations of the plurality of submunitions using each submunition's means for determining relative location.

13. The method of claim 12, further comprising sending target location information from the microprocessor of the delivery vehicle to respective microprocessors of each of the plurality of submunitions.

14. The method of claim 13, wherein the target location information includes a single desired target location for each submunition, a listing of all possible target locations, and a friendly/hostile identifier for each of the all possible target locations.

15. The method of claim 14, further comprising using each submunition's respective microprocessor and means for determining relative location to estimate the submunition's end location; then, comparing the submunition's estimated end location to its single desired target location; and then, executing a safe action if the estimated end location is not the single desired target location or if the desired target location has a friendly identifier.

16. The method of claim 15, wherein the safe action includes one of deactivating the submunition and detonating the submunition.

17. The method of claim 16, further comprising, for each submunition that reaches ground, wirelessly transmitting from the submunition information regarding location of the submunition and status of the submunition.

18. The method of claim 17, wherein the status information includes one of a pre-deactivation state and a pre-self-destruct state.

* * * * *